US006449338B1

(12) United States Patent
Bacal Verney et al.

(10) Patent No.: US 6,449,338 B1
(45) Date of Patent: Sep. 10, 2002

(54) X-RAY SOURCE AND USE IN RADIOGRAPHY

(75) Inventors: Marthe Bacal Verney, Paris; Jean-Max Buzzi, Antony; Christelle Gaudin, Bures-sur-Yvette; Dominique De Lapparent, Paris; Claude Rouille, Magny-les-Hameaux; Laurent Schwartz, Paris; Konstantin Serebrennikov, Palaiseau, all of (FR)

(73) Assignee: Ecole Polytechnique (FR)

( * ) Notice: Subject to any disclaimer, the term of this patent is extended or adjusted under 35 U.S.C. 154(b) by 0 days.

(21) Appl. No.: 09/674,791

(22) PCT Filed: May 4, 1999

(86) PCT No.: PCT/FR99/01052

§ 371 (c)(1),
(2), (4) Date: Nov. 3, 2000

(87) PCT Pub. No.: WO99/57946

PCT Pub. Date: Nov. 11, 1999

(30) Foreign Application Priority Data

May 4, 1998 (FR) ..... 98 05614

(51) Int. Cl.[7] ..... H01J 35/00
(52) U.S. Cl. ..... 378/121; 378/119
(58) Field of Search ..... 378/119, 121

(56) References Cited

U.S. PATENT DOCUMENTS 5,355,399 A * 10/1994 Golovanivsky et al. ..... 378/119
5,577,090 A * 11/1996 Moses ..... 378/64
5,838,760 A * 11/1998 Moses ..... 378/119

* cited by examiner

*Primary Examiner*—Robert H. Kim
*Assistant Examiner*—Jurie Yun
(74) *Attorney, Agent, or Firm*—Blakely Sokoloff Taylor & Zafman

(57) ABSTRACT

An X-ray emission device having a microwave source and a resonant chamber. The resonant chamber contains a hermedically sealed volume of gas, a magnetic structure defining a geometrical electron-confinement zone in which electrons move at high speed. At least one target is placed in an electron path in order to emit X-rays. Each target is offset with respect to a mid-region of the geometrical conbinement zone.

12 Claims, 9 Drawing Sheets

X-RAY SOURCE AND USE IN RADIOGRAPHY

The present invention relates to devices for emitting X-rays. More specifically, the invention relates to a novel X-ray source for applications in radiology, and in particular medical radiology.

Current X-ray sources employ tubes containing a gas at a very low pressure (of the order of $10^{-9}$ torr), in which a potential difference of about 50 to 100 kilovolts between a cathode and a target makes it possible to generate an electron flux moving at high speed in order to strike the target and emit X-rays. Their operation requires a high-tension supply, so these systems are by nature fixed, heavy and bulky. In addition, the presence of the transformers needed for the high-tension supply makes the total cost of the systems high, and imposes particularly restrictive operational and maintenance procedures.

A principle of X-ray emission by ECR (Electron Cyclotron Resonance) is known, which differs from that used by existing tube systems., and the implementation of which does not require a high-tension supply. This principle, which has been described in an article published in 1990 by Messrs. Garner et al. In [sic] Review of Scientific Instrumentation, is schematically as follows: under certain conditions, electrons emitted by a heated filament in a cavity, and exposed to microwave radiation, go into resonance so as to create a plasma in which, having reached high energy levels, the said electrons move at high speed. If a solid target is placed in the path of these high-energy electrons, the target can emit X-rays. By creating a magnetic field whose mid-plane intersects the volume of the cavity, using two magnets placed symmetrically with respect to the cavity, paths of high-energy electrons re observed which have the general shape of a ring lying substantially within the said mid-plane. The target can then be placed in this plane, in order for it to intercept high-energy electrons, so giving rise to X-ray emission. The emitted X-rays are then filtered by a thin window, made of a material such as glass, which is capable of guaranteeing that the cavity is gas-tight but which allows X-rays to pass through.

The implementation of this principle would have very considerable advantages with regard to the current tube sources, namely; a high-tension electrical supply source would no longer have to be provided, which would make the system safer, simpler to use, more economical and considerably more compact.

Attempts have been made to produce X-ray sources based on the principle of emission by ECR. These attempts, described in particular in patents U.S. Pat. Nos. 5,323,442, 5,282,899 and 5,327,475, have made it possible to produce X-rays, but in quantities and at energy levels which appear inadequate to envisage operational use, especially in medical radiology. In particular, certain applications of medical radiology require an X-ray flux to be produced with sufficient density and at an energy close to 100 keV, and the abovementioned attempts do not seem capable of producing such an X-ray flux.

A device is also known, from patent U.S. Pat. No. 5,355,399, which operates according to the same principle as the devices in the abovementioned patents and which emits X-rays, and a method associated with this device is known for the production of X-ray plates. However, in the latter device, the target, which lies in the mid-plane of the magnetic field, disturbs the generation of high-energy electrons, which results in limiting the output of X-rays emitted by the device. This has a direct effect on the operation of the device and on the quality of the images, since a low X-ray output entails long exposure times for the subject to be X-rayed, which, on the one hand is restricting in practice and, on the other, decreases the image resolution obtained because of movements by the subject during the exposure time. This major limitation prohibits the operational exploitation of the device. Thus, to date, there is no genuinely operational source of X-rays using ECR, although such a source would be transportable by virtue of its compactness, thus considerably broadening the field of application of X-ray imaging machines (use in medical imaging in environments which are difficult to access, for example at the site of an accident, or in industrial imaging, for example in submarines, aircraft or factories).

One object of the present invention is to enable a radiology device according to the principle of X-ray emission by ECR to be produced in such a way as to provide an X-ray output which is sufficient, in particular, to produce images of a quality at least equal to that of the current plates produced by tube machines, while using a compact and transportable X-ray source and without employing a high-tension supply.

A second object of the invention is to enable an X-ray source to be produced, whose response time to a control signal is short enough to produce fixed or moving X-ray images, A third object of the invention is to enable stereo X-ray images to be produced and to provide X-ray images in relief.

To achieve these objectives, the present invention proposes, according to a first aspect, an X-ray emission device comprising a microwave source, a resonance chamber containing a hermetically sealed volume of gas, a magnetic structure defining a geometrical electron-confinement zone in which electrons move at high speed and at least one target placed in an electron path in order to emit X-rays, characterized in that the or each target is offset with respect to a mid-region of the geometrical confinement zone.

Preferred, but non-limiting, aspects of the device according to the invention are as follows:

- the magnetic field is symmetric and the mid-region of the geometrical confinement zone is a plane;
- the magnetic structure comprises at least one pair of permanent magnets placed on either side of the resonance chamber;
- the magnetic structure comprises coils placed on either side of the resonance chamber;
- means to vary the intensity of the current in the coils are provided;
- the means to vary the intensity of the current in the coils are capable of varying the intensity slowly enough to allow the electrons to keep the ratio $B/\gamma$ almost constant, where B is the value of the magnetic field and $\gamma^2=1+v^2/c^2$, v being the electron speed, c the speed of light and $\gamma$ the electron mass;
- the device comprises means to alter the configuration of the magnetic structure so as to vary the energy of the X-rays emitted;
- the device comprises means to alter the position of the target or targets so as to vary the energy of the X-rays emitted;
- the microwave source comprises means to modulate the microwave emission;
- the device comprises two targets;
- the positions of the two targets are symmetric with respect to the central region of the geometrical confinement zone.

According to a second aspect, the invention also provides a radiography system comprising a device for emitting X-rays according to one of the aspects described hereinabove and comprising two targets; means to form two X-ray images of the same object from two different angles and means to reconstruct a stereo X-ray image of the said object.

Other aspects, objects and advantages of the present invention will become clearer on reading the following detailed description of a preferred embodiment of the invention, given by way of example and with reference to the appended drawings, in which.

Figure 5A:
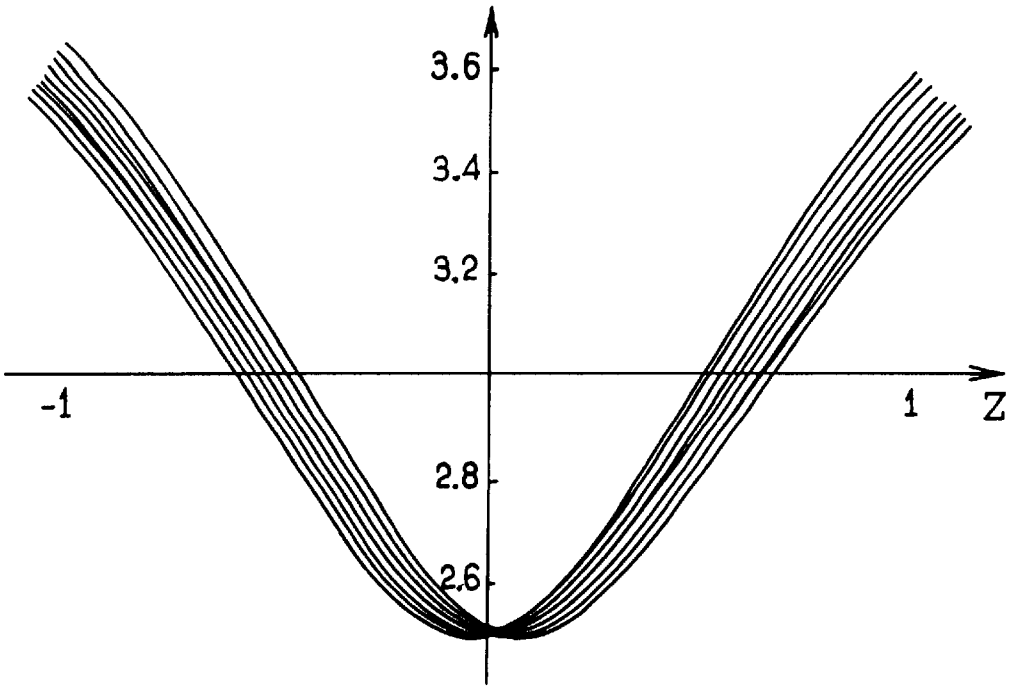
Figure 5B:
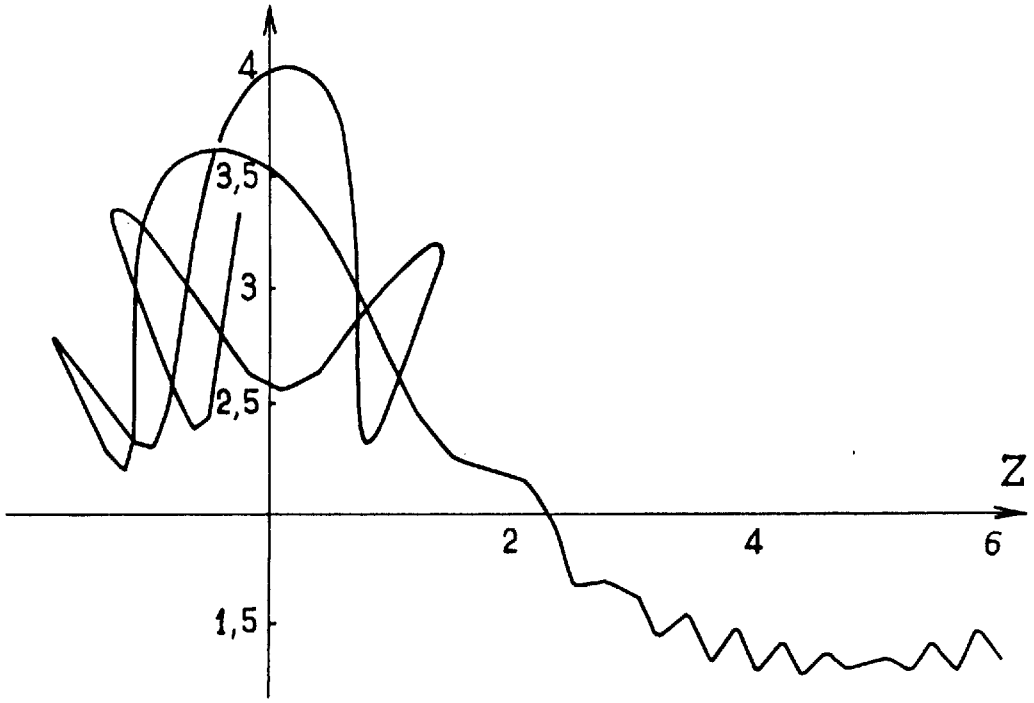
Figure 6A:
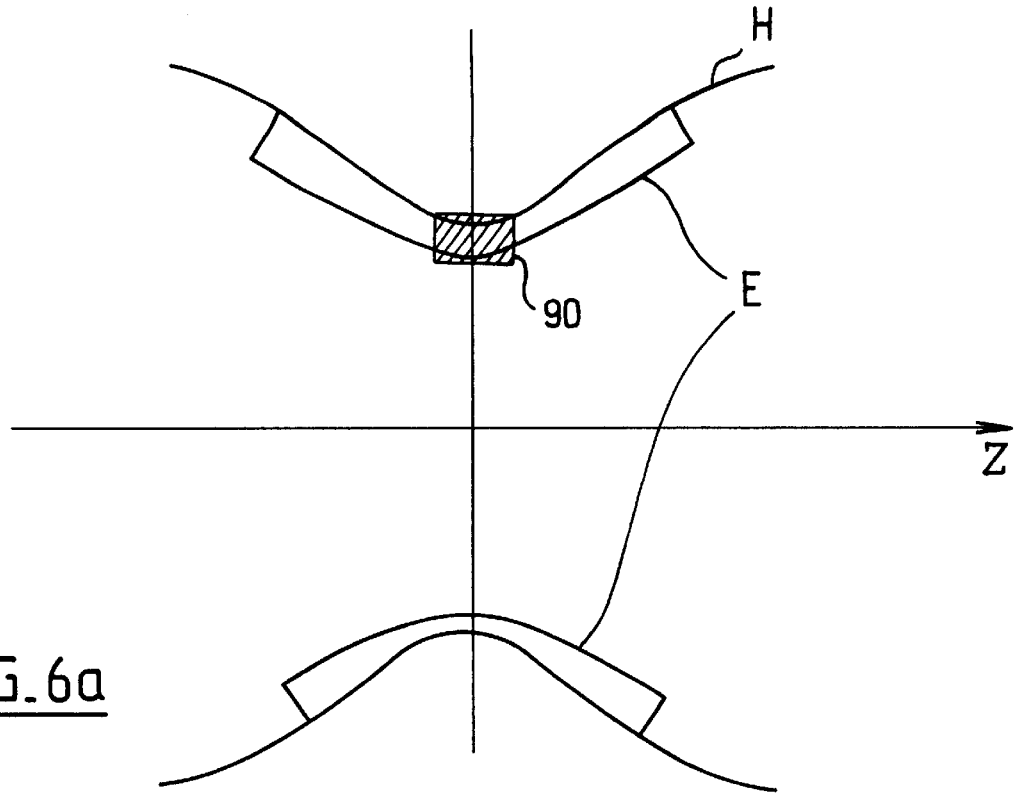
Figure 6B:
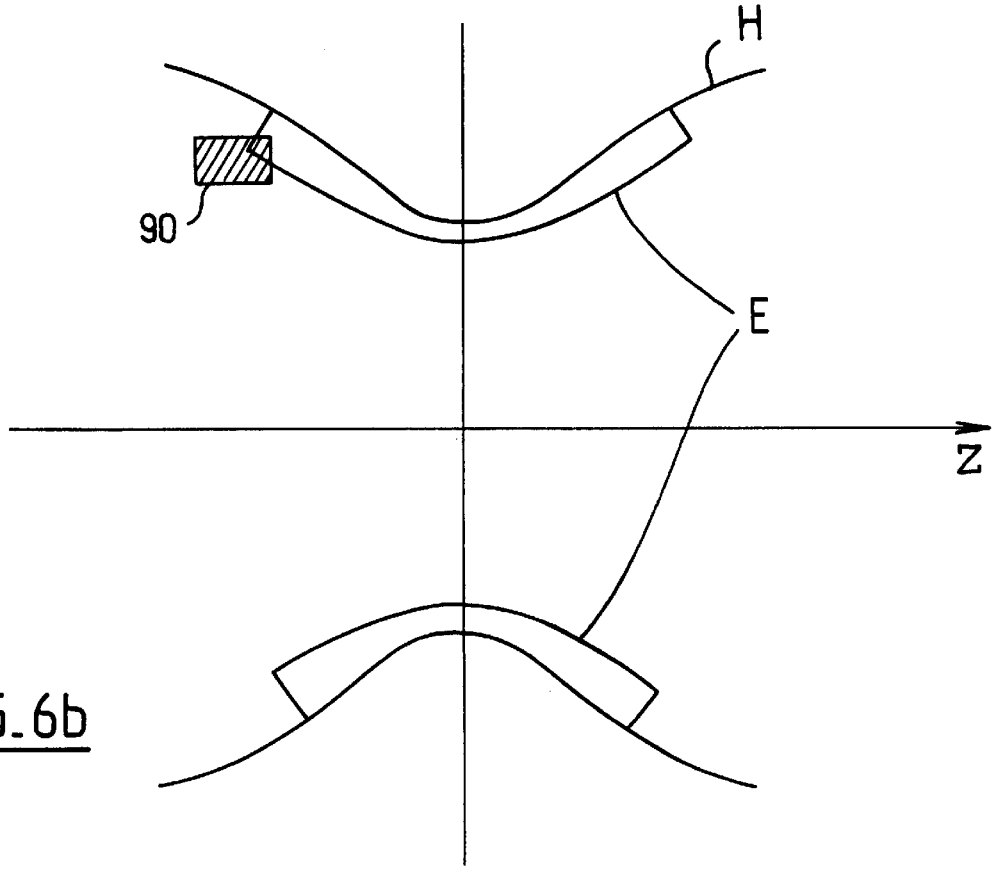
Figure 6C:
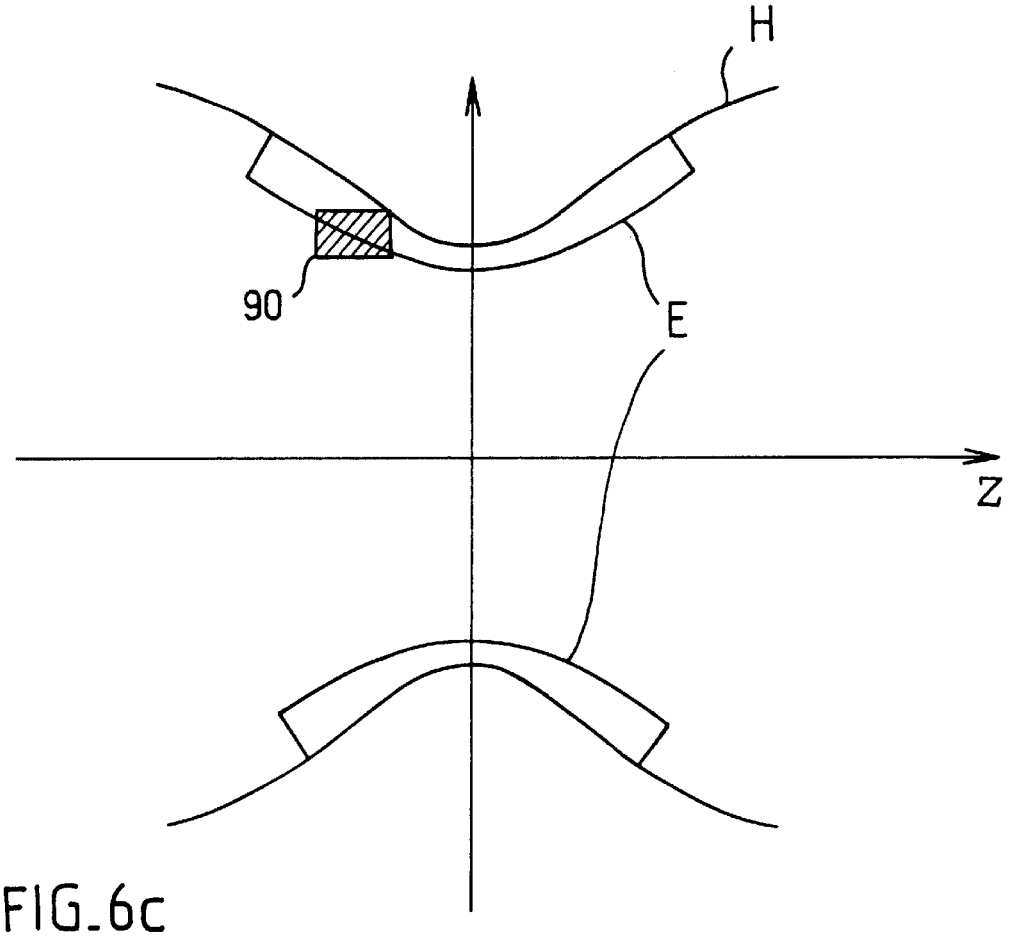
Figure 7:
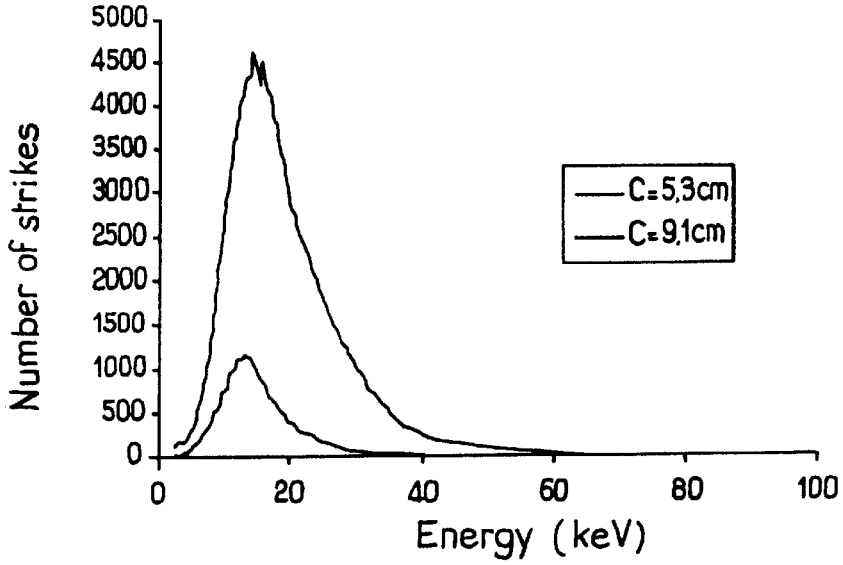
Figure 8:
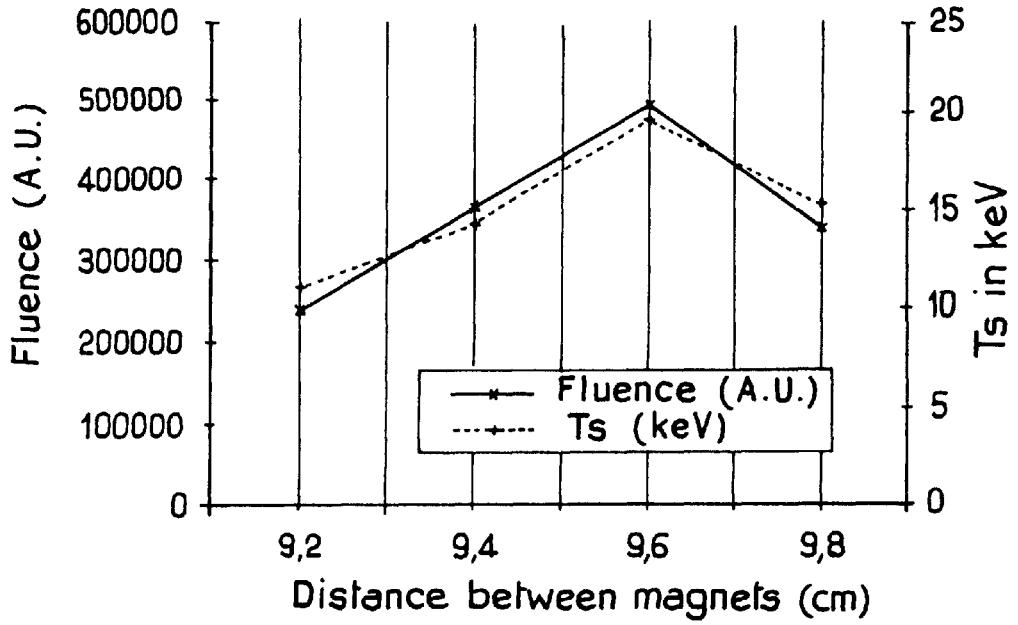
Figure 9:
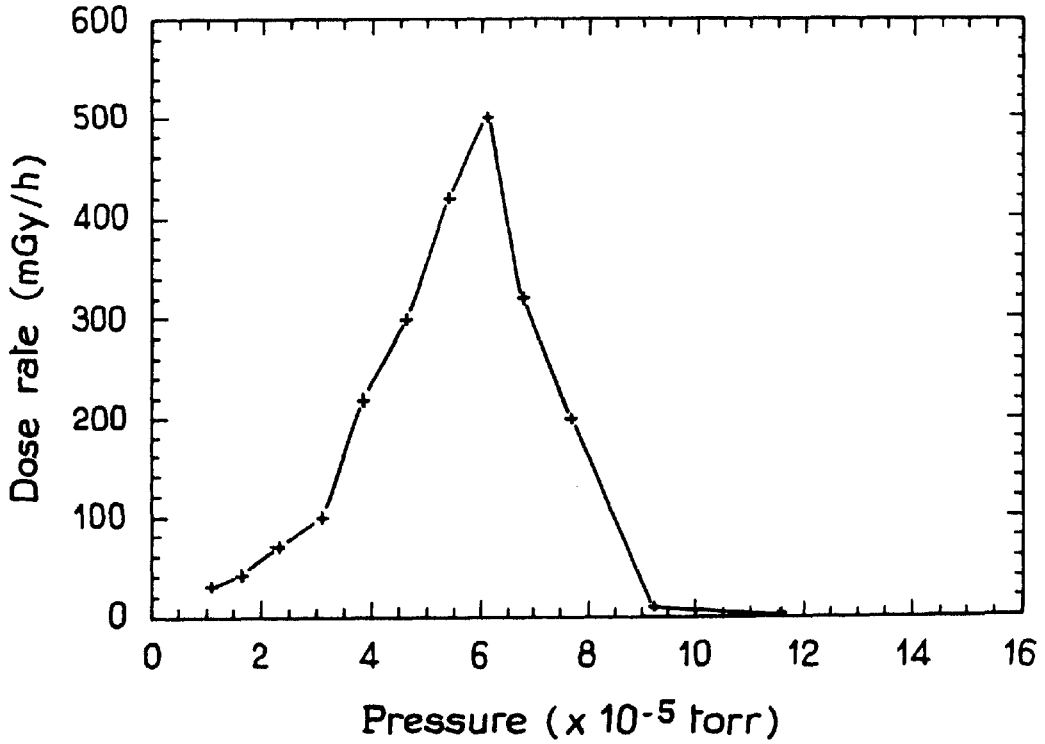
Figure 10:
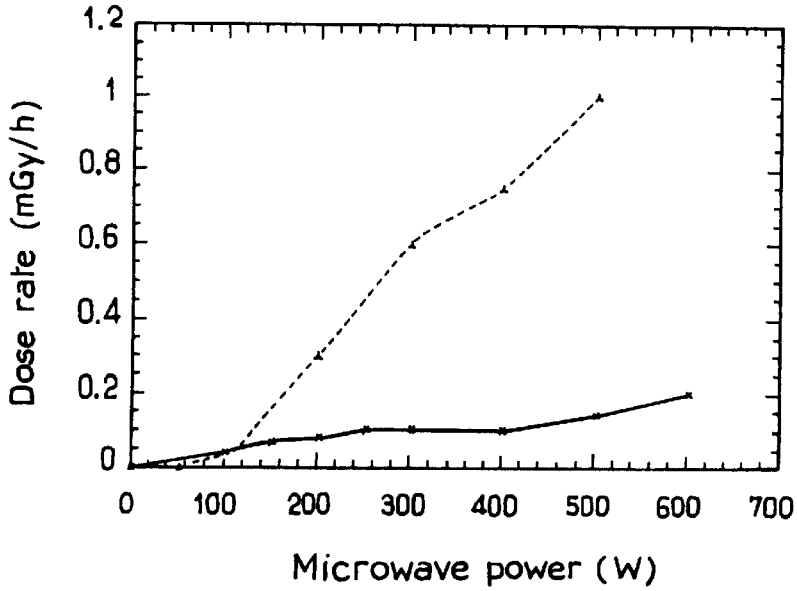
Figure 11:
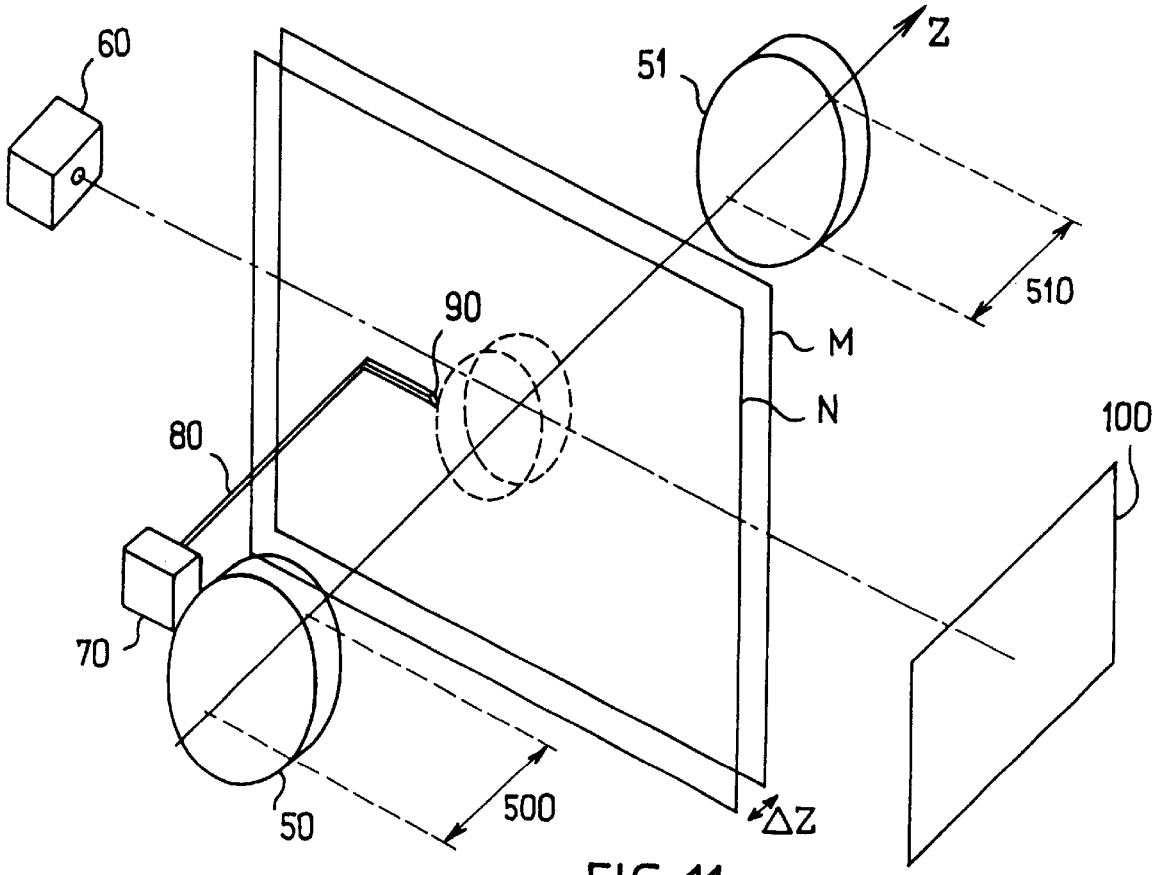
Figure 12:
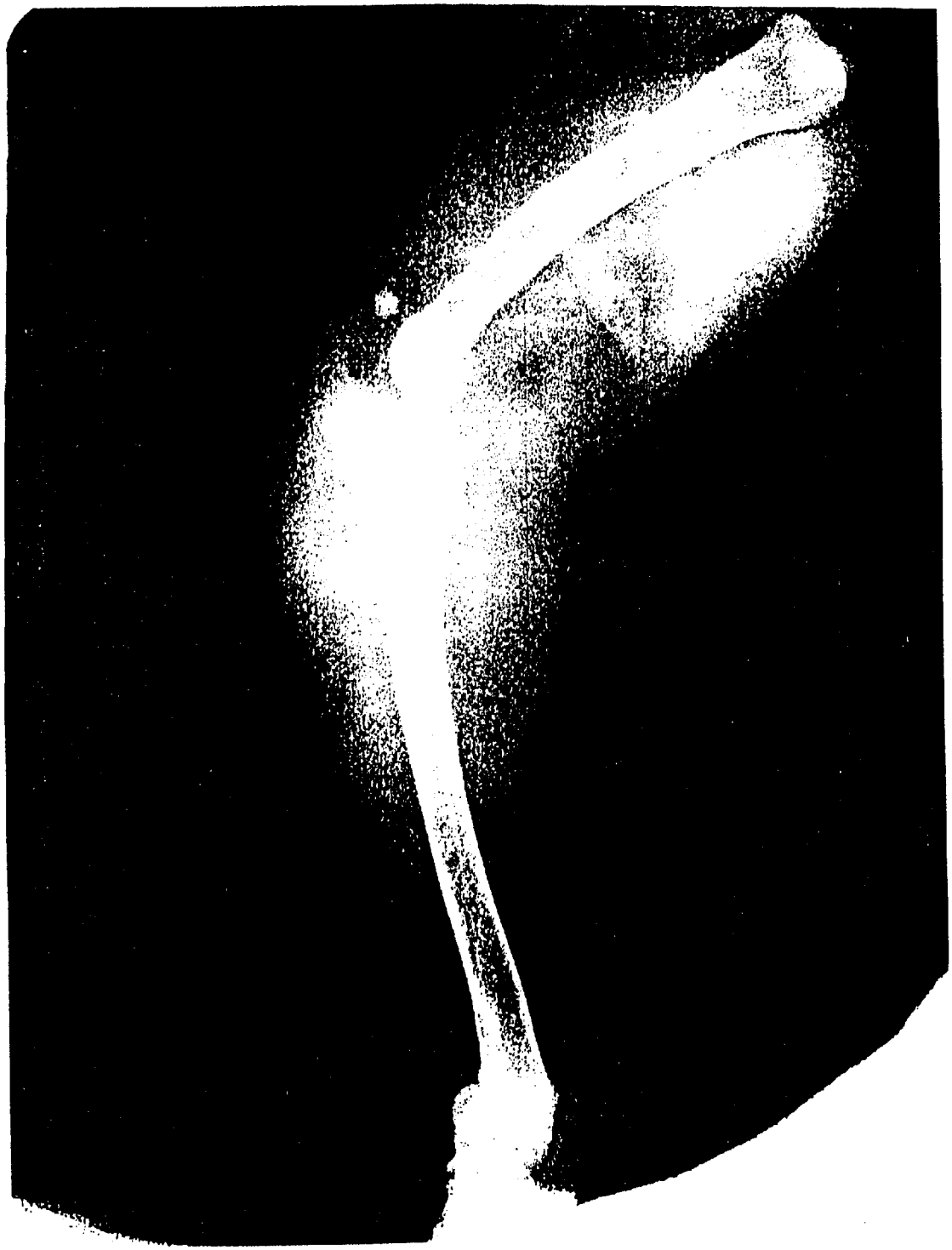
Figure 13:
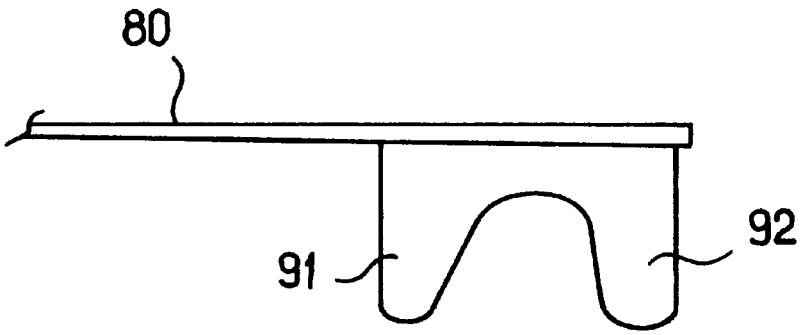
Figure 14:
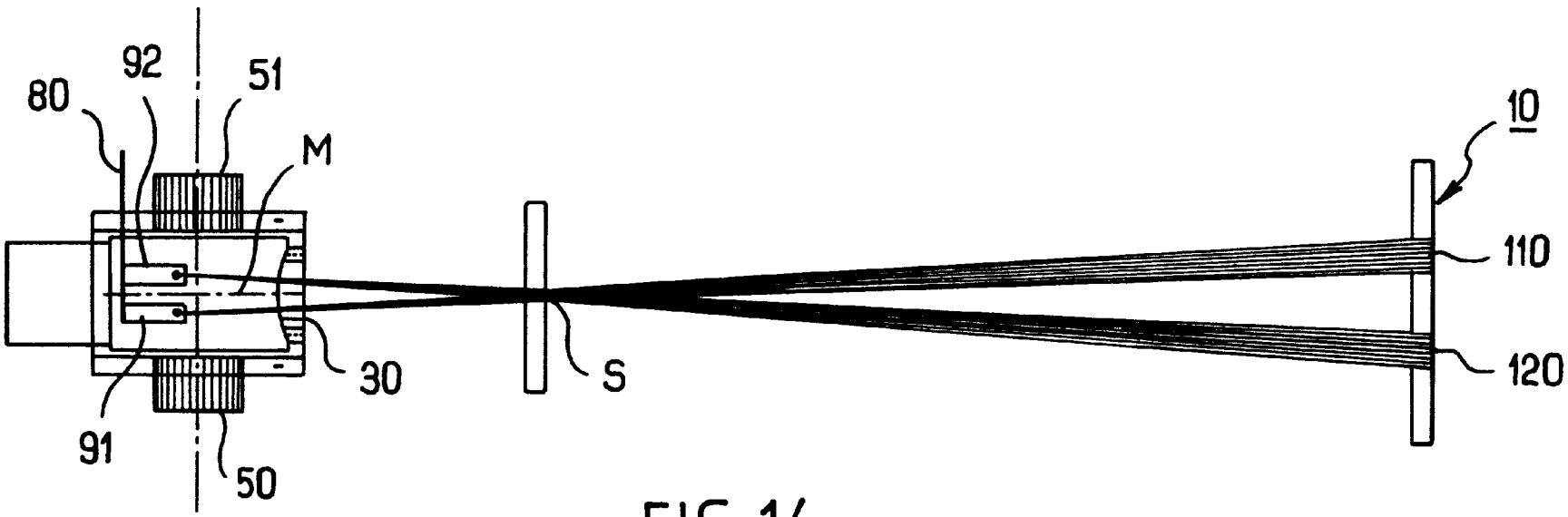

FIGS. 5*a* and 5*b* show high-energy electron paths in an ECRX source, obtained by modeling, for a distance between magnets of 6.2 cm. The electron energy is from 36 to 38 keV (FIG. 5*a*) and 40 keV (FIG. 5*b*);

FIGS. 6*a*, 6*b* and 6*c* are schematic representations of the position of a target in a device according to the invention;

FIG. 7 is a graph showing the change in intensity and in energy of the X-ray spectrum emitted by an ECRX source, as a function of the distance between magnets. The lower curve corresponds to a separation of 6.3 cm and the upper curve to a separation of 9.1 cm;

FIG. 8 is a graph showing the variation in intensity and in energy of the X-ray spectrum emitted by an ECRX source as a function of the distance between magnets;

FIG. 9 is a graph showing the variation in the dose rate of an ECRX source with target as a function of pressure, for a microwave power of 200 W and a distance between magnets of 6.2 cm;

FIG. 10 is a graph showing the variation in the dose rate of an ECRX source with target as a function of the microwave power, for a distance between magnets of 6.2 cm. The lower curve corresponds to a pressure of $2.3\times10^{-5}$ torr and the upper curve corresponds to a pressure of $6.2\times10^{-5}$ torr;

FIG. 11 is a schematic view of an ECRX source according to the invention;

FIG. 12 is an example of the image obtained using the device according to the invention;

FIG. 13 is a schematic representation of an embodiment of the target which can be used in the device according to the invention;

FIG. 14 is a schematic top view of an alternative embodiment of the invention.

Prior to the following description, it is stated that identical or equivalent components of the devices described are, as far as possible, denoted in the same way when referring to different figures.

Firstly, with reference to FIG. 1, an ECR X-ray source (ECRX source) of the type already known per se will be described. An aluminum enclosure 10 is hermetically sealed at its two ends by a window 20 which may be made from a material such as Teflon (registered trademark) or quartz, and by an aluminum window 30, respectively. The enclosure 10, sealed in this way by the windows 20 and 30, defines a cavity 40 filled with argon, the pressure of which is maintained at a setpoint value which may be between $10^{-6}$ and $10^{-4}$ torr, using a pressure regulator of a type known per se and not shown in the figures. On either side of the cavity 40 there are two identical and coaxial permanent magnets 50 and 51, inducing a magnetic field B with axis Z. This magnetic field is symmetric with respect to a mid-plane M containing a main direction of the cavity 40 and having an intersection with the said cavity. A microwave source 60, facing the window 20, is capable of injecting microwaves of frequency F, typically 2.45 gigahertz, through the said window in order to excite the electrons confined in the cavity 40. A tungsten target 90 is borne by a fixed support 80, in such a way as to lie in the mid-plane M. A receiving plate bearing a photosensitive film 100, of a type known and generally used in radiology, is located facing the aluminum window 30.

Figure 1:
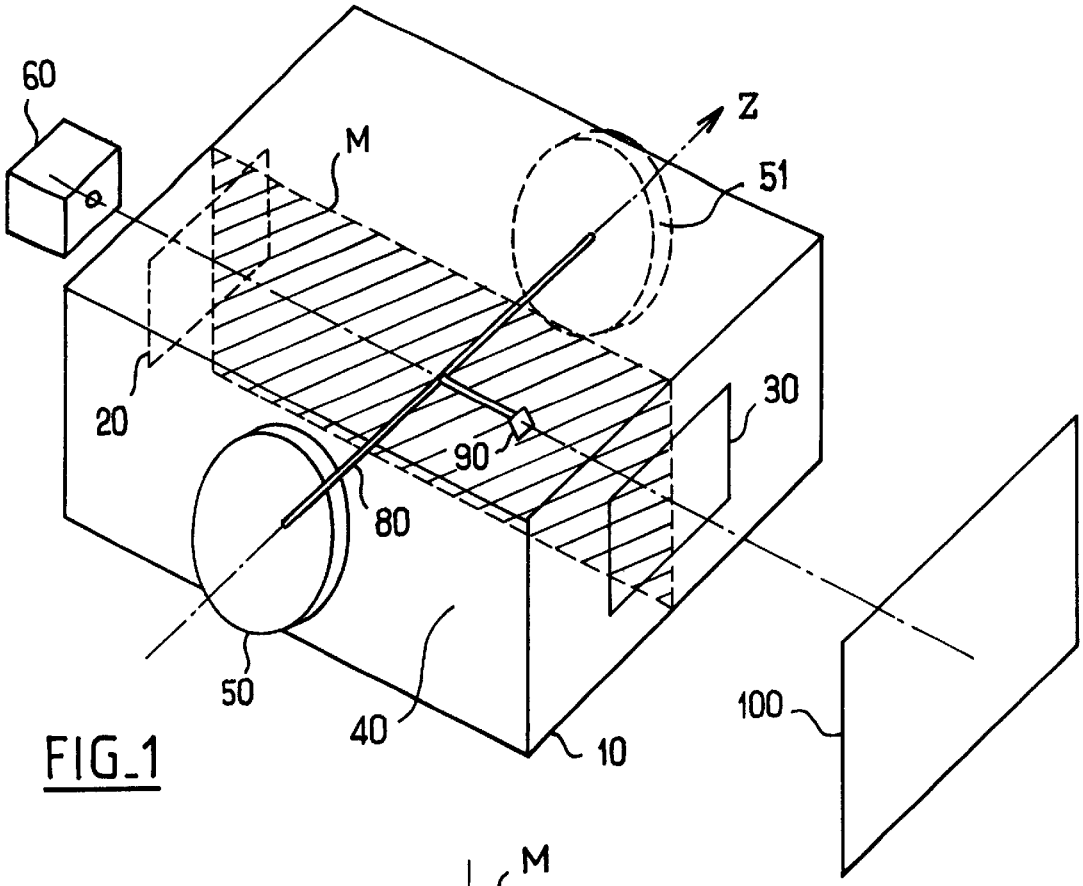
FIG. 1 is a schematic view of a ECRX source of a known type.
Figure 2:
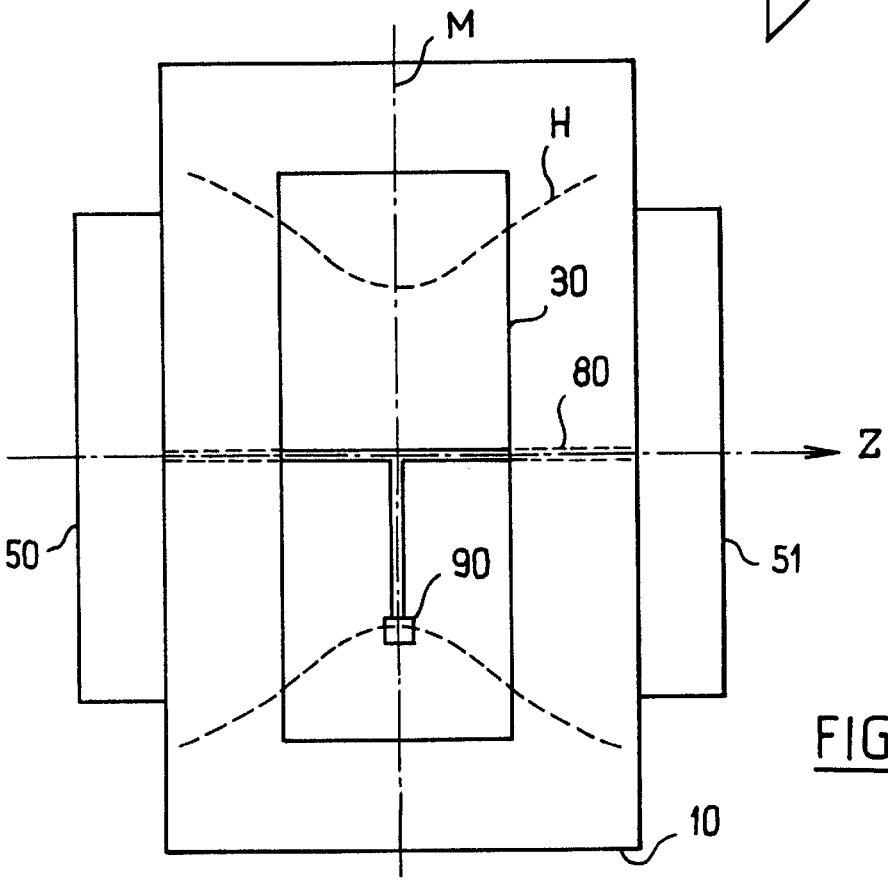
FIG. 2 is a schematic end-on view of an ECRX source of a known type.

The device of FIG. 1 is capable of emitting X-rays according to the following known principle: electrons subjected to microwave radiation coming from the source 60 become "high-energy" electrons, i.e. their energy increases, and each moves along particular paths. Thus, between the two magnets there is a so-called confinement zone H, having approximately the shape of a hyperboloid of revolution with axis Z, within which the paths of the electrons resonating with the microwaves and increasing in energy, lie. The electron energy is increased while the said electrons are confined in this resonance zone, and some of the paths of the high-energy electrons are consequently included in the resonance zone H, shown in FIG. 2. In the presence of the symmetric magnetic field B, the majority of the electrons are also confined in the mid-plane M, and their paths are close to a circle inscribed in the said mid-plane. According to the prior art, a tungsten target 90 is placed in that part of the mid-plane M included in the said hyperboloid and thus lies in the path of the high-energy electrons.

Figure 3:
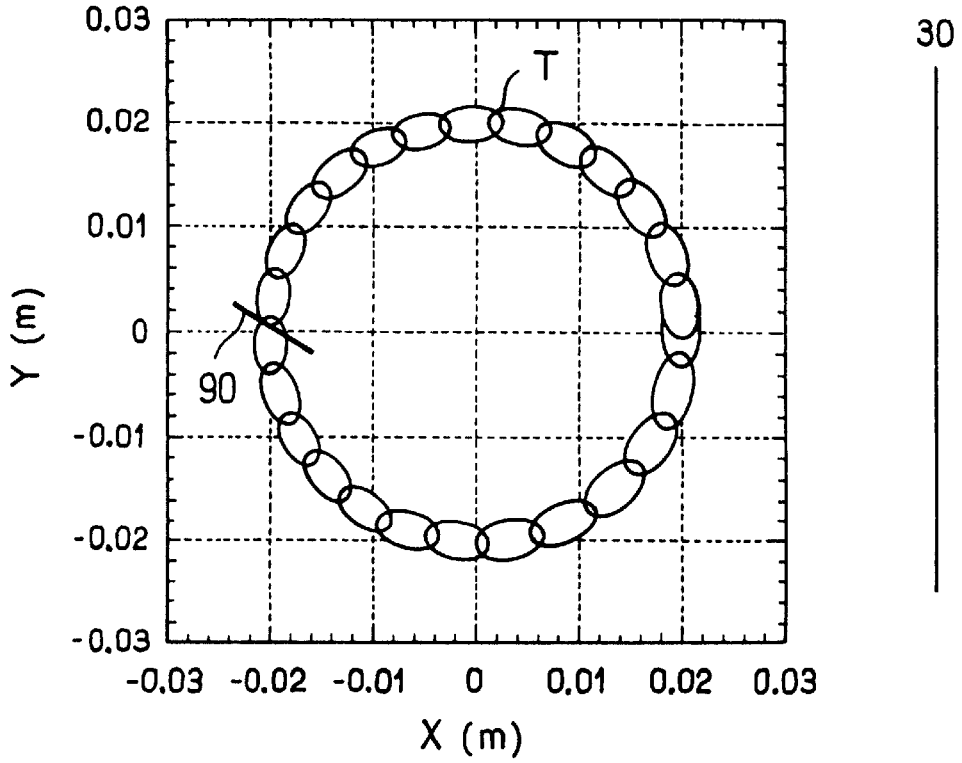
FIG. 3 is a schematic view of the path of the high-energy electrons in the mid-region of the magnetic field of an ECRX source.

The X-rays, generated by this bombardment of the target 90 by the electrons, are sent toward the aluminum window 30 by virtue of an appropriate orientation of the said target 90, as illustrated in FIG. 3 which schematically shows the envelope of the path T of a high-energy electron in the mid-plane M. The aluminum window 30 has two functions: on one hand, it ensures that the cavity 40 is sealed so as to contain the low-pressure argon inside the said cavity, on the other hand it must also be thin enough to allow the X-rays to leave the said cavity in order to strike the film 100. Using a device of this type it is possible to produce images of an object or of part of the body exposed between the aluminum window 30 and the film 100.

However, as mentioned, the plates obtained with this existing device, in which the target is placed in the mid-plane M, have low resolution.

Figure 4:
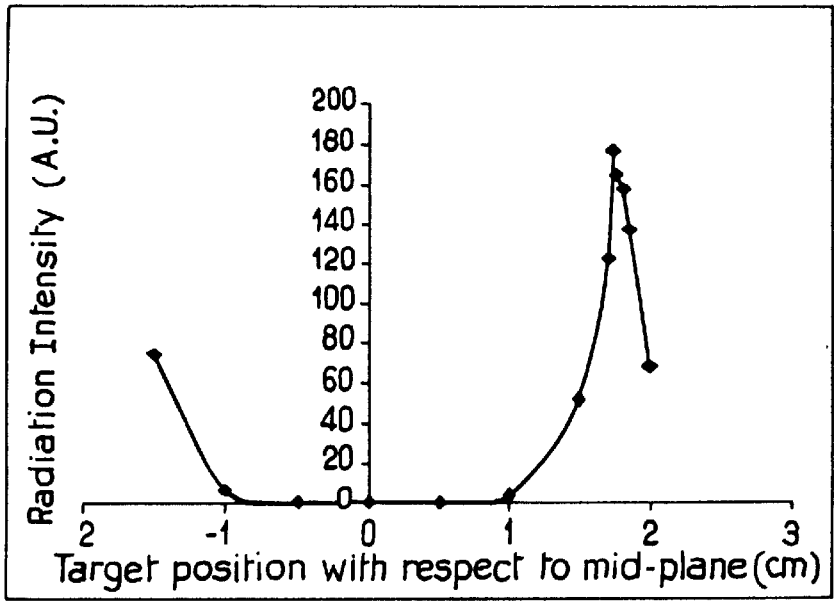
FIG. 4 is a graph showing the variation in intensity of the emitted X-ray radiation as a function of the target position with respect to the mid-plane of the magnetic field.

The Applicant has discovered that it is possible to substantially increase the radiation density of the X-rays emitted by an ECRX source by offsetting the position of the target out of the mid-plane M of the magnetic field. In order to demonstrate this property, the Applicant varied the target position on either side of the mid-plane, while keeping the radius (distance between the target and the Z axis) constant. The results of this experiment, which are presented in FIG. 4, show that there is an optimal position of the target with respect to the mid-plane.

To explain this phenomenon, the Applicant modeled the path of the high-energy electrons in the cavity 40. The model used was validated experimentally by comparing electron energy levels, as shown in the tables below, which present the maximum energy levels Emax of electrons for various values of the distance D between the magnets of the source, the said maximum energies being obtained, on the one hand, by modeling and, on the other, experimentally:

TABLE 1

| D (cm) | Emax modeled |
|---|---|
| 6.2 | 38 |
| 7.2 | 52 |
| 8.6 | 70 |
| 9 | 90 |

TABLE 2

| D (cm) | Emax experimental |
|---|---|
| 6.3 | 35 |
| 7.1 | 40 |
| 8.6 | 60 |
| 9.1 | 90 |

The modelization of the electron paths thus makes it possible to observe in FIG. 5*a* that the electron path cuts the mid-plane M, which corresponds in the figure to the y-axis (Z=0), along a circle of constant radius equal to 2.5 cm, while outside this mid-plane the radii of the path are dispersed.

By placing the target 90 in the mid-plane, as illustrated in FIG. 6*a* in which the resonance zone H and the envelope E of the traces of the path of a high-energy electron in the horizontal plane including the Z axis are represented schematically, the electrons are therefore certain to be intercepted from the start of their movement in the resonance zone, although the said electrons will probably only be of low energy. By now placing the target in the path of the electron out of the mid-plane, as illustrated in FIG. 6*b*, the probability of intercepting the electron only after it has made a certain number of revolutions about the magnetic axis Z, i.e. after it has reached a high energy level, is increased; consequently the energy of the X-rays emitted is increased. FIG. 6*c* illustrates an intermediate position of the target in the path of the electrons, between the central position of FIG. 6*a* and the marginal position of FIG. 6*b*.

In order to accurately quantify the phenomenon demonstrated and to optimize a device making it possible in particular to produce a sufficient output of X-rays whose energy is close to 100 keV for use in medical radiology, the Applicant has identified parameters affecting the operation of an ECRX source, and characterized the effects of these input parameters of the device on the emission of X-rays, which is itself described by two output parameters. The following table summarizes the input and output parameters of the device:

| Device parameters (input) | X-rays parameters (output) |
|---|---|
| Target position | Energy of emitted rays (E) |
| Incident microwave power (Pu) | Radiation intensity (I), comparable to dose rate (Dd) |
| Gas pressure in the cavity (P) | |
| Magnetic field (B), and distance between magnets (D) | |

From theoretical calculations and practical experimentals, the Applicant has thus demonstrated the properties of X-ray emission by ECR, making it possible to produce an ECRX source comprising at least one target out of the mid-plane M and whose operation is optimized according to the invention. These properties are as follows:

It is possible to make the energy and the intensity of the emitted X-rays vary as a function of the separation of the magnets (distance between the magnets) which surround the cavity. This is because the Applicant has measured the X-ray spectra emitted by an ECRX source. The graph in FIG. 7 shows that by moving the magnets symmetrically further apart without altering the position of the mid-plane M of the magnetic field, a much greater intensity of X-ray radiation is output. Furthermore, the energy peak of the emitted spectrum then moves toward increasing energies, and the energy of the emitted rays increases up to 80 keV. In the case presented in FIG. 7, the fact of moving the magnets further apart, changing their separation from 5.3 to 9.1 cm, makes it possible to emit a large quantity of radiation at around 30 keV, which makes it possible to envision practical X-ray applications for tissues and more particularly, for mammography.

For the X-rays emitted, there is a maximum energy E and a maximum intensity I for a given value of the distance between magnets D. As shown in FIG. 8, the Applicant has demonstrated the fact that, beyond a certain value of D (9.6 cm in the case of FIG. 8), the energy and the intensity of the emitted spectrum decrease rapidly. This phenomenon is due to the change in configuration of the resonance zone H, whose axis of revolution tilts beyond this distance D, and this has the effect of modifying the operating regime of the ECRX source. Thus with an ECRX source. It is therefore possible to alter the distance between magnets D in order to optimize the characteristics of the X-ray emission spectrum.

There is an optimal value of the argon pressure P for each operating point (P$\mu$, D), as indicated in FIG. 9. The demonstration of this property makes it possible to change the pressure P to its best value according to the values of P$\mu$ and of D using the regulator with which the ECRX source is fitted.

For each value of D, there is a maximum energy value that the electrons contained in the resonance zone H may have. This maximum energy is very high, since it defines the upper limit of the energy level of the X-rays emitted by the ECRX source and, consequently, the conceivable practical applications. The results presented in Tables 1 and 2 above, obtained by modeling and validated by experimental measurements, demonstrate the increase in this maximum energy with the separation D. It is thus possible to predict the maximum energy associated with each magnet configuration. The model from which the values in Table 1 arise also makes it possible to calculate the high-energy electron path in the resonance zone H. FIGS. 5*a* and 5*b* show the paths of two electrons, the energies of which are situated on either side of the maximum energy value, for a distance between magnets of 6.2 cm. In FIG. 5*a*, the electron path is confined to the resonance zone. Conversely, the electron in FIG. 5*b* has acquired an energy level which does not allow it to remain in the resonance zone, and the path of this electron diverges far from the mid-plane M defined by (Z=0).

The dose rate of the X-rays emitted depends on the power of the microwaves coming from the source 60. FIG. 10 indeed shows the increase in the dose rate Dd emitted by a target placed in an ECRX source, as a function of the microwave power $P\mu$. This property is equally important since the dose rate is a parameter which appears to limit the performance of the existing ECRX sources and currently precludes their operational exploitation. Among the operational parameters, the microwave power $P\mu$ is therefore one of the factors which makes it possible to reach the desired dose rate.

Thus it appears that it is possible to substantially improve the performance of ECRX sources, on the one hand, by increasing the energy of the X-rays emitted through altering the separation D between the magnets creating the magnetic field B and, on the other hand, by increasing the dose rate through altering the microwave power $P\mu$ and the position of the target away from the mid-plane M, and finally through altering the pressure P inside the cavity.

The characteristics of the device according to the invention are represented schematically in FIG. 11. This device adopts the elements of the known device represented in FIG. 1. These elements are denoted in the same way as in FIG. 1, and they will not be described again in the following paragraphs.

The ECRX source according to the invention is fitted with a device 70 for three-dimensional displacement of the support 80 of the target 90. The said target, which intercepts the electrons when they lie in the part of their path located at the side of the microwave source 60, is, according to the invention, placed, using the displacement device 70, in a plane N parallel to the mid-plane M and offset by a distance $\Delta z$ with respect to the said plane M. The target 90 in this embodiment of the invention is formed by a beveled surface at the end of a rod, but it may be formed by a plane surface element of any geometry, the orientation of which is controlled in order to orient the emitted X-ray beam. The displacement device 70 makes it possible to alter the position of the target with an accuracy of about a millimeter or better. Such a device is known per se and will not be described in more detail in the present description. It should be noted that the support 80 for the target 90 is made of a material such as a ceramic, which is resistant to the impacts of high-energy electrons. However, the magnets 50 and 51 are not fixed as in the known device in FIG. 1, but are capable of being displaced along the magnetic axis Z, in order to travel along the segments 500 and 510 respectively. The movement of the magnets may be controlled by a positioning system also known per se, not shown in FIG. 11. The microwave source 60 delivers radiation whose power can be altered, for example between 0 and 1000 W. It is thus possible according to the invention to adjust the distance between the magnets, the microwave power, the target position and finally the setpoint value of the pressure in the cavity 40, in order to optimize the radiation emitted. The device according to the invention therefore makes it possible to carry out adjustments in order to alter the X-ray energy on the one hand, and their dose rate on the other. An example of an X-ray image obtained on the film 100 is shown in FIG. 12.

According to a variant of the invention, the microwave source 60 may emit in a pulsed manner in the direction of the cavity 40. This pulsed operation makes it possible to generate high-energy electrons in the cavity which are also in a pulse mode, since the rise and fall times of the electron energy are extremely short. Thus, the source generates X-ray pulses, the durations of which may typically be of the order of one nanosecond. This variant is therefore particularly advantageous for applications which only need short exposure times, such as scintigraphy or fluorimetry which need exposure times of the order of one millisecond. For these applications, pulse emission makes it possible to minimize the actual exposure time, in comparison with the existing tube systems which have long rise times (from "heating" of the cathode) and which needlessly expose the subject, leading to risks of carcinogenesis.

According to another variant of the invention, the ECRX source comprises two targets 91 and 92, mounted on the support 80 as shown in FIG. 13. This particular configuration makes it possible to have two X-ray emission points available. By placing the two targets symmetrically with respect to the mid-plane M, using the displacement device 70 and as indicated in FIG. 14, the two targets intercept the electrons making it possible to emit the same spectrum. It is then possible to place a subject S between the two-target ECRX source according to the invention and the photosensitive film 100, on which two images of the subject will be formed at 110 and 120. These two images correspond to two different angles of viewing the same subject, and it is therefore possible to combine these two images in order to reconstruct a stereoscopic X-ray image.

According to a third variant of the invention, it is possible to replace the magnets with electromagnetic coils. In this particular case, the coils may act as magnets mounted on a displacement system used to vary the separation of the said coils. In this variant with coils, it is also possible to use two or more targets mounted on the support 80, and to vary the electrical supply of the coils in order to control the position of the mid-plane M so that the electrons strike the various targets of the ECRX source selectively and alternately. The latter variant allows the lifetime of the targets to be extended substantially.

According to a fourth variant of the invention, in order to create the magnetic field B, it is possible to use both permanent magnets and at least one pair of coils in which the current is made to vary slowly in order to generate a variable magnetic field superimposed on the fixed magnetic field B generated by the permanent magnets. In this respect, it is known that a variation of the magnetic field, if it extends over an interval of time typically greater than one millisecond, makes it possible to keep the ratio $B/\gamma$ constant, where B is the value of the magnetic field and $\gamma$ has a quantity directly linked to the energy. Such a variation therefore constitutes an additional means of increasing the energy of the electrons in the ECRX source.

For the purposes of illustration, the present description uses a configuration of the ECRX source in which the magnetic field is symmetric and defines a mid-plane M in which the high-energy electrons are confined. However, the invention is in no way limited to this particular embodiment. It is indeed possible according to the invention to produce an ECRX source in which the magnetic field is not symmetric; such an ECRX source also comprises a confinement zone for the high-energy electrons comprising a mid-region, equivalent to the mid-plane M used in the present description, where the geometry of the said mid-region may not be plane.

Finally, it is possible according to the invention to use at least two targets fixed to the support 80, the said support being moved by the device 70 with an alternating translational movement along the Z axis, in order to alternatively present each of the targets with electron impacts. This solution also enables the lifetime of the targets to be extended.

What is claimed is:

1. X-ray emission device comprising a microwave source (60), a resonance chamber (10) containing a hermetically sealed volume of gas, a magnetic structure (50, 51) defining a geometrical electron-confinement zone (H) in which electrons move at high speed and at least one target (90, 91, 92) placed in an electron path in order to emit X-rays, characterized in that each target is offset with respect to a mid-region (M) of the geometrical confinement zone (H).

2. Device according to claim 1, characterized in that the magnetic field is symmetric and the mid-region of the geometrical confinement zone (H) is a plane (M).

3. Device according to claim 1 or 2 characterized in that the magnetic structure comprises at least one pair of permanent magnets (50, 51) placed on either side of the resonance chamber (10).

4. Device according to claim 1, characterized in that the magnetic structure comprises coils placed on either side of the resonance chamber (10).

5. Device according to claim 4, characterized in that means to vary the intensity of the current in the coils are provided.

6. Device according to claim 5, characterized in that the means to vary the intensity of the current in the coils are capable of varying the intensity slowly enough to enable the electrons to keep the ratio $B/\gamma$ almost constant, where B is the value of the magnetic field and $\gamma^2=1+v^2/c^2$, v being the electron speed, c the speed of light and $\gamma$ the electron mass.

7. Device according to claim 1, characterized in that the device comprises means to alter the configuration of the magnetic structure so as to vary the energy of the X-rays emitted.

8. Device according to claim 1, characterized in that the device comprises means (70, 80) to alter the position of the target or targets (90, 91, 92) so as to vary the energy of the X-rays emitted.

9. Device according to claim 1, characterized in that the microwave source comprises means to modulate the microwave emission.

10. Device according to claim 1, characterized in that the device comprises two targets.

11. Device according to claim 10, characterized in that the positions of the two targets are symmetric with respect to the central region of the geometrical confinement zone (H).

12. Radiography system comprising a device for emitting X-rays according to claim 10, means (91, 92, 100) to form two X-ray images of the same object (S) from two different angles and means to reconstruct a stereo X-ray image of the said object (S).

* * * * *